United States Patent [19]

Nishioka

[11] Patent Number: 4,471,747

[45] Date of Patent: Sep. 18, 1984

[54] PRE-LOADING ARCHERY BOW

[76] Inventor: Jim Z. Nishioka, 1268 Hemlock, NW., Salem, Oreg. 97304

[21] Appl. No.: 331,659

[22] Filed: Dec. 17, 1981

Related U.S. Application Data

[63] Continuation of Ser. No. 88,014, Oct. 25, 1979, abandoned, which is a continuation-in-part of Ser. No. 753,358, Dec. 22, 1976, abandoned.

[51] Int. Cl.[3] ..... A41B 5/00

[52] U.S. Cl. ..... 124/23 R; 124/88

[58] Field of Search ..... 124/63, 69, 23 R, 24 R, 124/41 A, 35 A, 88

[56] References Cited

U.S. PATENT DOCUMENTS

| | | | |
|---|---|---|---|
| 2,815,016 | 12/1957 | Kellogg | 124/23 R X |
| 3,233,601 | 2/1966 | Walther | 124/69 |
| 4,041,927 | 8/1977 | Van House | 124/24 R X |
| 4,207,858 | 6/1980 | Blackstone | 124/88 X |

*Primary Examiner*—Richard J. Apley
*Assistant Examiner*—William R. Browne

[57] ABSTRACT

An archery bow has the usual grip portion for manually holding the bow with one hand and also has a bowstring extending between opposite ends of the bow arms. Mechanism is supported on the bow which is arranged to pre-load energy into the bow in a step prior to shooting the arrow, such pre-loaded energy being releasable by a draw force on the bowstring. The bow has controls for holding the pre-load and for releasing such pre-loaded energy.

13 Claims, 20 Drawing Figures

212
216a
210
245
232
216
236
238
228
244
242
220
240
224
226
246
216b
214
218

222
244
220
230
226
232
238
228
234
224
242
216b 226
232
216b
238
220
222
224
228

256
250
254a
248
254
260
268
262
274
264
266
270
272

274
260
250
252
258
256

PRE-LOADING ARCHERY BOW

CROSS REFERENCE TO RELATED APPLICATIONS

This application is a continuation of application Ser. No. 088,014, filed Oct. 25, 1979, now abandoned, which is a continuation in part of application Ser. No. 753,358, filed Dec. 22, 1976, now abandoned.

BACKGROUND OF THE INVENTION

This invention relates to new and useful improvements in archery bows and particularly pertains to an archery bow having pre-loading means.

Arrow speed is dependent upon several factors, one of the most important being the amount of energy put into the bow. Generally speaking the more total energy put into the bow, the faster that the arrow will be propelled. Increased arrow speed is desirable, especially when hunting and shooting heavy arrows. Shooting a bow is difficult because of the power required to draw back the bowstring and for this reason many persons such as women are not capable of entering into archery. Even persons who have sufficient strength to draw a bow find it difficult to shoot accurately since aiming the bow and drawing back the bowstring must be accomplished simultaneously.

SUMMARY OF THE INVENTION

According to the invention, an archery bow is provided which can be pre-loaded so that an initial energy can be loaded into the bow and held by control means and such pre-loaded energy is releasable by applying an additional drawing force on the bowstring.

To provide the above objective, energy means of the bow, such as one or more flexible arms or auxiliary arms can be pre-loaded and control means are employed that are operative to hold the pre-loading means in a loaded condition. The control means are releasable by an additional draw force on the bowstring. One embodiment employs a flexible limb to take slack out of the bowstring during the loading function and also to provide extra pre-loading energy to the bow. Another embodiment employs an adjustably movable bow arm which pre-loads the bow under the influence of a fluid operated pump operated by a hand lever or by single or multiple drawing movements of the bowstring. Further yet, an auxiliary flexible bow arm on a bow having stiff bow arms can be used to provide the energy means, and pre-loading thereof is accomplished by a flexible link operated similar to the bowstring.

DETAILED DESCRIPTION OF PREFERRED EMBODIMENTS

Figure 1:
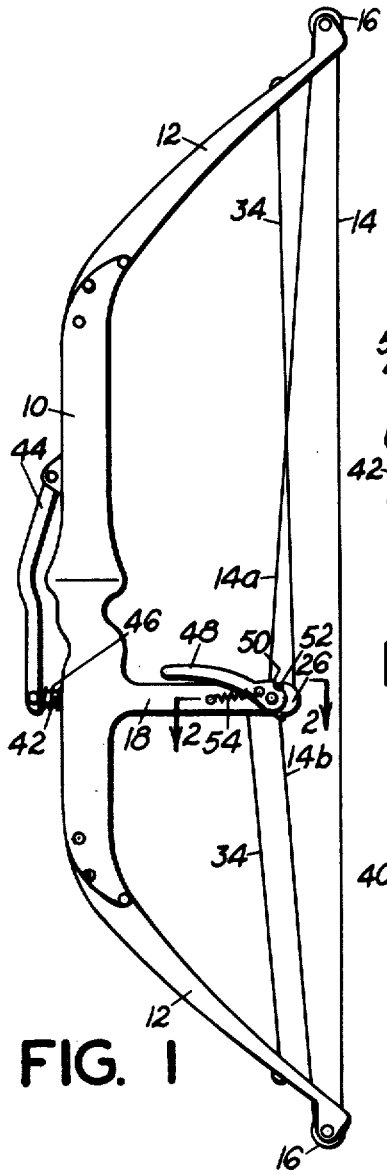
FIG. 1 is a side elevational view of a first form of pre-loading archery bow embodying principles of the present invention.
Figure 2:
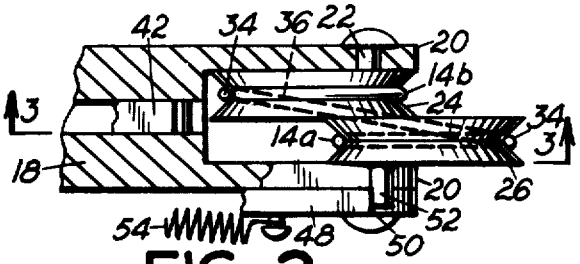
FIG. 2 is an enlarged fragmentary sectional view taken on the line 2—2 of FIG. 1.

With particular reference to the drawings, FIGS. 1 through 5 show a first embodiment of the invention. In this embodiment, an archery bow has a frame portion 10 and flexible bow arms or limbs 12 that produce the energy for the bow. A bowstring 14 having end portions 14*a* and 14*b* is associated with the bow and operates over end pulleys 16 in energy producing functions of the bow as well as pre-loading functions now to be described.

Figure 3:
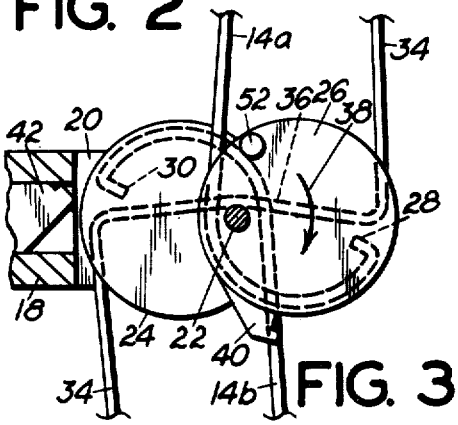
FIG. 3 is a fragmentary sectional view taken on the line 3—3 of FIG. 2 and showing a rest condition of pre-loading means.
Figure 5:
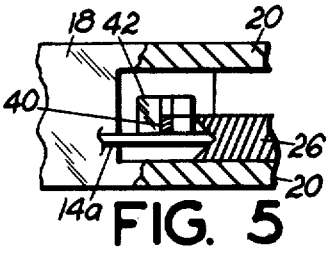
FIG. 5 is a fragmentary sectional view taken on the line 5—5 of FIG. 4.

An arm 18 integral with the frame portion of the bow extends rearwardly, namely, toward the bowstring, and has a bifurcated end 20 with a cross shaft 22 secured therein which supports two pulleys 24 and 26 secured together in offset relation. With reference to FIG. 3 which shows a rest condition of the parts, bowstring end 14*a* engages the left side of pulley 26 and has an end 28 secured to the pulley. Bowstring end 14*b* engages the right side of pulley 24 and has an end 30 secured to such pulley. The bowstring ends 14*a* and 14*b* are disposed on opposite sides of the shaft 22.

The pre-loading means also include a flexible link or line 34 having its opposite ends secured to the opposite bow arms adjacent the ends of the latter. This link leads down onto the right side of pulley 26, then passes diagonally through a bore 36 in the pulleys 26 and 24, and then it leads down from the left side of pulley 24. Upon partial rotation of the double pulley in the direction of arrow 38, the flexible link 34 pulls on the bow arms and causes them to flex inwardly to partially load the bow.

Figure 4:
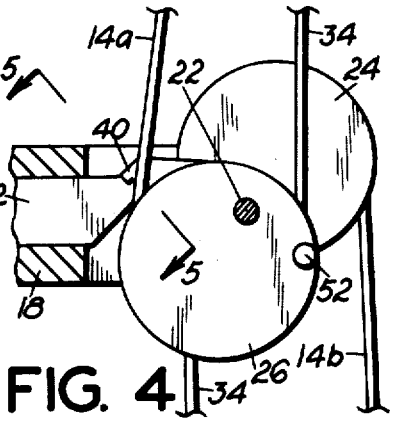
FIG. 4 is a view similar to FIG. 3 but showing a loaded condition of pre-loading means.

This pre-loaded condition is maintained by a lug 40 on pulley 26 arranged for engagement with a latch bar 42 slidably mounted in the arm 18 and arranged to project into the bifurcated end of the arm 18 for engagement with the lug 40. FIG. 3 shows the pulley assembly in rest position, and FIG. 4 shows the pulley assembly rotated clockwise an amount sufficient for engagement of the lug 40 by the latch bar 42 to hold the pulleys in pre-loaded condition. The latch bar 42 projects forwardly through the frame portion of the bow and has pivotal connection to a hand lever 44 parallel with and adjacent to the gripping portion of the bow. A return spring 46 is disposed between the bow and the lever 44 to urge the latch bar 42 outwardly whereby in a release position of the latch bar, it will be moved forwardly out of the way of the pulley assembly but upon being moved inwardly by the operator by his manipulation of the lever 44, the latch bar will engage the lug 40. Lug 40 has a selected hook engagement with the latch bar whereby the latter will remain latched until such time that the pulley assembly is rotated further in a clockwise rotation.

Rotation of the pulley assembly to the loaded condition can be accomplished by hand if desired although it is preferred that a setting lever 48 be employed for this purpose for ease of pre-loading. Such lever has pivotal support on the arm 18 and has a notched portion 50 engageable with a projecting pin 52 on the pulley 26. A tension spring 54 is connected between the lever 48 and the arm 18 to urge the lever to a lowered rest position.

In the operation of the FIG. 1 embodiment, the lever 48 is pivoted clockwise to move the pulley assembly around to a position wherein lug 40 bypasses latch bar 42. The archer pulls in on lever 44 to move the latch bar into the path of the lug and then releases the setting lever 48 while at the same time maintaining pressure on the lever 44. The lug 40 will engage and maintain the latch bar 42 in position for holding the pulley assembly in pre-loaded position. The pre-loading rotation of the pulley assembly flexes the bow arms inwardly to provide pre-loaded energy to the bow. Such energy is thus available for propelling a projectile such as an arrow and is released by drawing the bowstring outwardly to a point where the pulley assembly is rotated sufficiently to release the latch bar 42 from lug 40. Thus, upon releasing the bowstring, the arrow is propelled by the pre-loaded energy and of course also by extra energy put into the bow by the final draw of the bowstring.

It is noted from FIGS. 3 and 4 that when the pulley assembly is rotated to pre-loaded condition, the influence of bowstring end sections **14*b* and 14*a* on the pulley assembly increases and the influence of the flexible link 34 decreases. Therefore, less draw force is required to draw the bowstring as it approaches the point where the bow is locked into pre-loaded condition. In the final draw, a draw force is required to continue the rotation of the pulley assembly to allow release of latch bar 42**.

FIGS. 6 through 9 illustrate another embodiment of the invention. In this arrangement, a bow has a frame portion 60 with flexible bow arms 62 and a bowstring 64 with end portions **64*a* and 64*b*. The bowstring operates over end pulleys 66, and the frame portion of the bow has a rearwardly extending arm 68 with a bifurcated end portion 70 supporting a shaft 72 on which a pair of pulleys 74 and 76 secured together in offset relation are rotatably supported. Another pulley 78 is rotatably supported on the shaft 72 in concentric relation, and secured to this pulley is a fourth pulley 80, the latter pulley being secured to pulley 78 but in an eccentric relation on the shaft. This embodiment employs a flexible link 82 having opposite ends thereof connected to the bow arm and this link extends down the right side of pulley 76, through a diagonal aperture 83 in the pulleys 74 and 76, and then down from the left side of pulley 74**.

Figure 8:
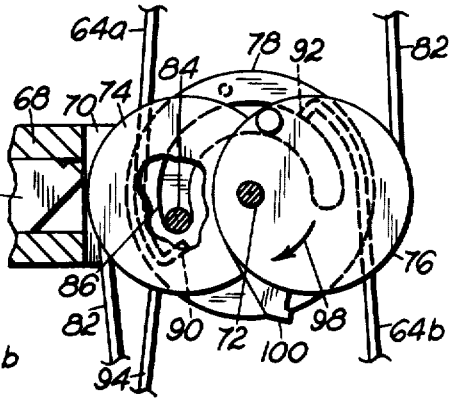
FIG. 8 is a sectional view taken on the line 8—8 of FIG. 7 and showing a rest condition of pre-loading means.

Pulley 78 is adjacent to pulley 74 and has limited relative rotation therewith. This limited rotation is controlled by a laterally projecting pin 84 on the pulley 74 which operates in an arcuate slot 86 in the side of pulley 78. In a rest position of the parts as shown in FIG. 8, the pin is disposed at the left-hand end of slot 86, and it is thus apparent that pulley 74 can rotate approximately 180 degrees before the pin 84 will reach the other end of the slot, at which time the pulley 78 will turn with the pulley 74. bowstring end **64*a* engages the left side of pulley 78 and has an end 90 anchored to the pulley. Bowstring end 64*b* engages the right side of pulley 78 and has an end 92 anchored to said pulley. Pulley 80 is associated with a flexible link 94 having one end anchored to said pulley and the other end secured to the free end of a flexible limb 96** secured to the frame portion of the bow.

Pulley 76 has a lug 100 thereon arranged for engagement with a latch bar 102 slidable in the arm 68 and controlled by a hand operated lever 104 on the front of the bow as in the previous embodiment. A setting lever 106, also as in the previous embodiment, is mounted on the arm 68 to rotate the pulley assembly. In the operation of this embodiment, the pulley assembly is rotated by hand or by the lever 106 in a clockwise direction to a point where the lug 100 is latched to the latch bar 102. This rotative movement causes the bow arms to flex because of the shortening of flexible link 82 around the pulleys 74 and 76. Such rotation is independent of pulleys 78 and 80 since the pin 84 rides in the slot 86. As the bow arms are drawn together by the shortening of flexible link 82, pulley 78 however tends to rotate with pulley 74 and 76 due to the pull thereon from the bowstring. However, the flexible limb 96 through the link 94 urges pulley 80, and thus pulley 78, in a counterclockwise direction to take up slack in the relaxed bowstring. The pre-load in this embodiment, similar to the first embodiment, is released by an additional pull on the bowstring, whereby the energy which was pre-loaded into the bow and the energy put into the bow on the final draw are made available when the operator releases the bowstring. It is to be noted that the bow arms are pre-loaded first in this concept; however, with a selected arrangement of pulleys, lug 100 and latch bar 102, the flexible arm could be pre-loaded first.

Another concept of the invention is illustrated in FIGS. 10 through 13. In this embodiment, the bow has a frame portion 110 having a first flexible bow arm 112 rigidly secured thereto and a second flexible bow arm 114 pivotally attached thereto by a connection 116 with the frame portion. A plunger 118 is secured on the frame portion 110 and is engageable upon fluid operation thereof to bear against the arm 114 and increase or decrease the flexing power thereof. Plunger mechanism 118 is connected to a pump 120 mounted on the frame portion of the bow and having a projecting push rod 122 extending in front of the bow and arranged upon reciprocation thereof to operate a piston of the pump. A connecting conduit 124 extends between the plunger mechanism 118 and the pump, and a relief valve 126 is provided on the pump to release pressure. A pivoted operating lever 128 extends in front of the bow parallel therewith and is arranged to be pivotally operated by the hand that holds the bow to provide pump operation of the plunger mechanism 118.

Figures 10, 11, 12, 13, 14, 15:
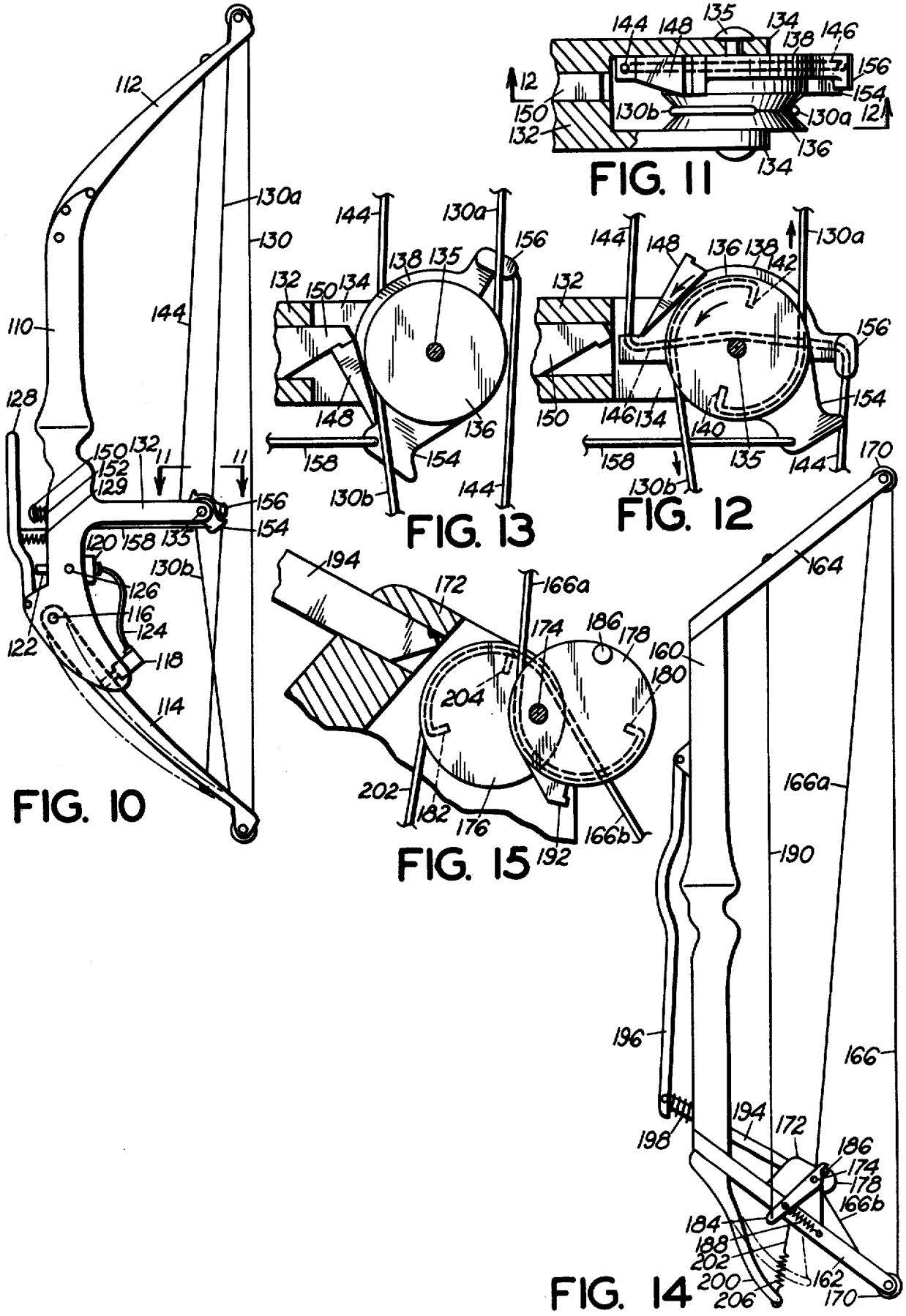
FIG. 10 is an elevational view of an archery bow embodying a further modification of the invention.
FIG. 11 is an enlarged fragmentary plan view, partly broken away.
FIG. 12 is a sectional view taken on the line 12—12 of FIG. 11 and showing a rest condition of pre-loading means.
FIG. 13 is a view similar to FIG. 12 but showing a loaded condition of the pre-loading means.
FIG. 14 is an elevational view of an archery bow illustrating a further modification of the invention.
FIG. 15 is an enlarged fragmentary sectional view of pre-loading means used with the embodiment of FIG. 14, such pre-loading means being shown in rest condition.

This bow embodiment has a bowstring 130 with end portions 130*a* and 130*b*. An arm 132 extends integrally from the frame portion of the bow and has a bifurcated end 134 with a cross shaft 135 therein which supports a pulley 136 and a disc 138 integral with the pulley 136. Bowstring end 130*a* engages the right side of the pulley 136 and has an end 140 secured to the pulley, and the end 130*b* engages the left side of pulley 136 and has an end 142 secured to the pulley. A flexible link 144 has its opposite ends secured to the bow arms and this link passes through a lateral bore 146 in the disc 138 whereby to enter one side of the disc and exit on the other side. Disc 138 has a lug 148 thereon adapted for engagement by a latch bar 150 slidable in the arm 132 and projecting through the front of the bow and being urged outwardly by a return spring 152. FIG. 12 shows the rest position of the parts, and engagement of the lug 148 by the latch bar 150 is accomplished by counterclockwise rotation of the disc 138, as will be more apparent hereinafter.

Pulley 136 has a hook projection 154 thereon arranged for engagement with a lobe 156 on the disc 138 upon counterclockwise rotation of the pulley 136. A flexible link 158 is connected between the projection 154 and the hand lever 128.

In the operation of this embodiment, the pulley 136 and disc 138 are disposed in the position of FIG. 12 when at rest. To pre-load the bow, the operator pulls the bowstring and this turns pulley 136 counter-clockwise whereby projection 154 engages lobe 156 and turns disc 138 to a point where lug 148 moves past latch bar 150. The archer at this time pushes in on latch bar 150 and then releases the bowstring to cause lug 148 to engage latch bar 150. During this loading function of the bow, the hand lever 128 moves inwardly by the flexible link 158 to operate the pump. This will cause an initial extra flexing of arm 114 since the plunger mechanism 118 will be operated by the pump and expanded thereby. If it is desired to provide additional pre-loading force to the bow, it is only necessary for the archer to again apply draw force to the bowstring to apply pumping action of the hand lever 128 which in turn operates the pump 120. Such may be done by short draw pulls on the bowstring to prevent release of the lug 148 from the latch bar 150, or if desired the latch bar 150 may be manually held and longer draws can be made.

In the embodiment of FIGS. 14 and 15, a bow has a frame portion 160 and rigid bow arms 162 and 164. A bowstring 166 operates over end pulleys 170 and is connected to pre-loading means now to be described.

Such pre-loading means comprises a bracket 172 secured integrally on the bow arm 162, and such bracket has a cross shaft 174 therein which supports a pair of pulleys 176 and 178 secured together in offset relation. Bowstring end 166*a* engages the left side of pulley 178 and has an end 180 anchored to such pulley. Bowstring end 166*b* engages the right side of pulley 176 and has an end 182 anchored to such pulley.

A setting lever 184 is pivotally supported on bracket 172 and has engagement with a projecting pin 186 on the outside of pulley 178 in an arrangement such that upon clockwise rotation of the lever, the pulley assembly is also rotated clockwise for pre-loading the bow. A return spring 188 is connected between the bow arm and the setting lever, and a flexible link 190 such as a cable or bowstring is connected between the lever 184 and the opposite bow arm. Pulley 178 has a lug 192 thereon arranged for engagement with a latch bar 194 slidably mounted in the bracket 172 and connected to a hand operated lever 196 pivotally attached to the bow frame. A return spring 198 urges the latch bar to its released position.

Energy for the bow of FIG. 14 is accomplished by an auxiliary bow arm 200 which is flexible and which is connected to the pulley assembly by a flexible link 202 such as a cable. Link 202 passes over the left side of pulley 176 and has an end 204 secured thereto. A cushioning spring 206 is incorporated in the link 202.

In the operation of the embodiment of FIG. 14, the operator pulls rearwardly on the flexible link 190 and this rotates the pulley assembly by means of the lever 184. A drawing force on this flexible link is made which is sufficient to rotate the lug 192 past the latch bar, whereupon the archer can move the latch bar rearwardly to a set position and then release the link 190 to engage the lug with the latch bar. Rotation of the pulley assembly as just described pre-loads the bow by flexing the bow arm 200 to its broken line position of FIG. 14, and to release this energy, the archer pulls rearwardly on the bowstring 166 to a point where lug 192 and latch bar 194 are disengaged and energy from the bow arm 200 can propel the arrow.

Figures 16, 17, 18, 19, 20:
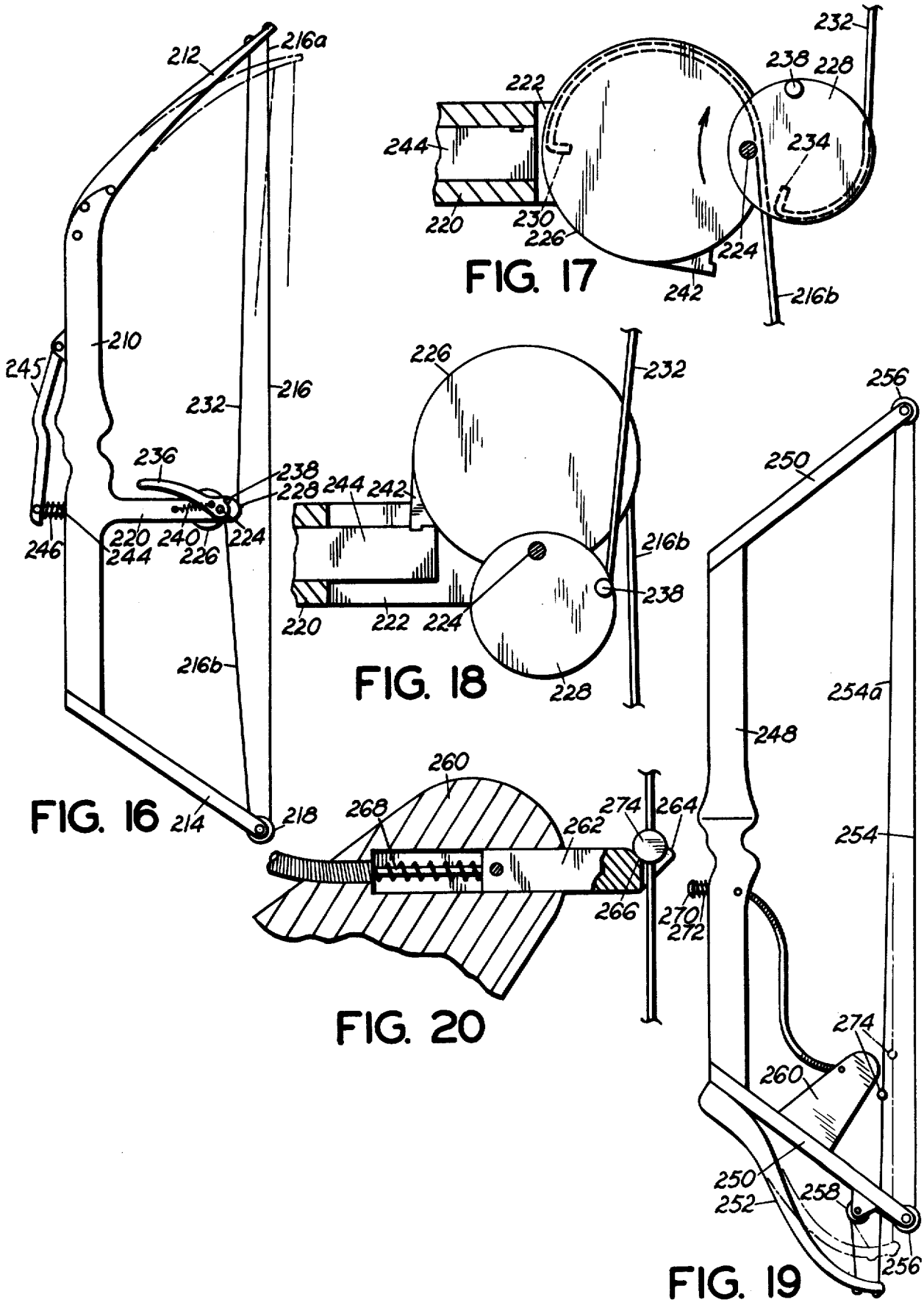
FIG. 16 is an elevational view of an archery bow showing still a further modification.
FIG. 17 is an enlarged fragmentary sectional view of pre-loading means used with the embodiment of FIG. 16, such pre-loading means being shown in rest condition.
FIG. 18 is a view similar to FIG. 17 but showing pre-loading means of the embodiment of FIG. 16 in a loaded condition.
FIG. 19 is an elevational view of an archery bow showing yet a further modification of the invention.
FIG. 20 is an enlarged sectional view of pre-loading means used with the embodiment of FIG. 19, the pre-loading means being shown in loaded condition.

FIGS. 16, 17 and 18 illustrate a further embodiment wherein a bow has a frame portion 210 provided with a flexible arm 212 and a rigid arm 214. The bowstring 216 has opposite end portions 216*a* and 216*b*, the end 216*a* being secured to flexible bow arm 212 and the end 216*b* working over a pulley 218 on the rigid bow arm. An arm 220 extends rearwardly from the bow and has a bifurcated end 222 supporting a cross shaft 224 having a pair of pulleys 226 and 228 thereon. These two pulleys are secured together in offset relation. Bowstring end 216*b* engages the right side of pulley 226 and has an end 230 secured to the pulley. A flexible link 232 has one end secured to the outer end portion of flexible bow arm 212 and the other end thereof engages the right side of pulley 228 and has an end 234 secured to the pulley. A setting lever 236 is pivotally attached to the arm 220 and is engageable with a pin 238 on the pulley 228 for rotating the pulley assembly to a a pre-loaded position. A return spring 240 maintains the lever 236 in a rest position. Pulley 226 has a lug 242 thereon arranged for engagement with a latch bar 244 slidable in the arm 220 and operated by a hand lever 245 pivotally attached to the bow. Latch bar 244 is urged to its release position by a spring 246.

The bow is pre-loaded by drawing the bowstring or rotating lever 236 to a point where latch bar 244 can be caused to engage lug 242. As in previous embodiments, the pre-loaded energy is releasable by an additional pull on the bowstring. Rotation of the pulley assembly also provides a pre-loading energy by the tension applied to flexible link 232, the pulleys 226 and 228 being sized to provide linear movement of the bowstring and flexible link 232 according to their differential in travel.

FIGS. 19 and 20 show an embodiment wherein a bow has a frame portion 248 and rigid bow arms 250, and a flexible arm 252 is secured to one of the bow arms in angled relation. The bowstring 254 passes over end pulleys 256 and has an end portion 245*a* which is connected directly to the free end of flexible bow arm 252 and an end 254*b* which extends over another pulley 258 and is also connected to the end of flexible arm 252.

A bracket 260 is secured to the bow arm 250 which is adjacent the flexible arm 252 and has a spring pressed latch bar 262 slidable therein having a bifurcated end 264 with a top edge recess 266. Latch bar 262 is connected to a flexible cable 268 leading to a push rod 270 slidably supported in the bow, said plunger being associated with a return spring 272 for returning it to an outward position. An enlargement 274 is secured to the bowstring and is arranged for engagement with the bifurcated end 264 of latch bar 262. In pre-loading the bow, the bowstring 254 is drawn which causes the flexible arm 252 to flex upwardly to the broken line position of FIG. 19. The enlargement 274 moves with the bowstring and upon movement to a selected position, the end 264 of the latch bar is moved thereunder as in FIG. 20. The bow will thus remain pre-loaded until further draw is put on the bowstring wherein the enlargement 274 will raise and allow the latch bar to release under the action of spring 272 to an out of the way position whereby the energy from the flexible bow arm 252 can propel the arrow.

According to the invention, pre-loading energy can be put into a bow and the energy required to shoot the bow merely comprises a final draw on the bowstring which may not require much effort and strength. The pre-loading energy is maintained in the bow even though the bowstring is free from a drawing force. In some of the embodiments, the bowstring will be free of or substantially free of tension in the pre-loaded condition of the bow. The pre-loading means are operated by leverage devices such that great strength is not required to accomplish such pre-loading, and the energy which propels the arrow is greater than the energy which is required for the final draw of the bowstring. Thus persons of minimum strength can take to archery and become skilled at it.

The embodiments shown in FIGS. 1, 6, 10, 14 and 16 have pre-load energy means which cause the peak force which propels the arrow to be greater than the peak force which is required on the final draw of the bow. This improves arrow speed.

When a bow, such as shown in FIG. 1, is drawn without first pre-loading, the draw force required on the bowstring to draw the bow and thus energy put in the bow increases in initial portions of the drawing movement, then the draw force peaks to the highest draw force required during the draw, and then during the final drawing movements, the draw force required on the bowstring decreases.

The peak draw force required to draw the bow may be such that the archer cannot draw the bow. According to the invention, energy means may be pre-loaded in the bow to a point past the peak draw force required on the bowstring. The archer is aided in this pre-loading operation by a leverage device which increases his leverage. When the archer draws the pre-loaded bow, he encounters the draw force required in the final stages of the draw which requires a decreasing draw force.

Thus, it can be seen that pre-loading of the bow produces a decrease in the draw force required to draw the bowstring relative to that draw force required for drawing the bow from an undrawn condition to a drawn condition prior to pre-loading. Pre-loading allows the archer to shoot a bow which is more powerful than he is capable of drawing and this is an important feature of the invention.

Figure 7:
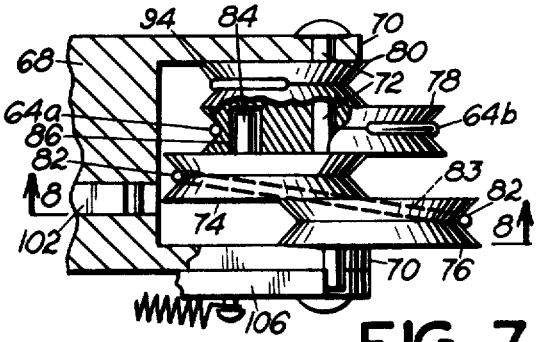
FIG. 7 is an enlarged fragmentary sectional view taken on the line 7—7 of FIG. 6.
Figure 6:
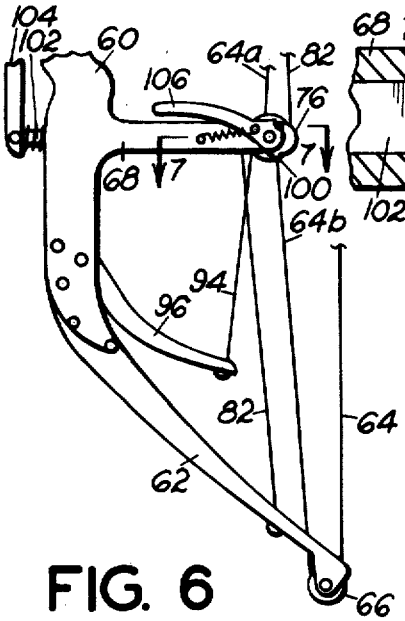
FIG. 6 is a fragmentary elevational view of an archery bow embodying a modification of the invention.
Figure 9:
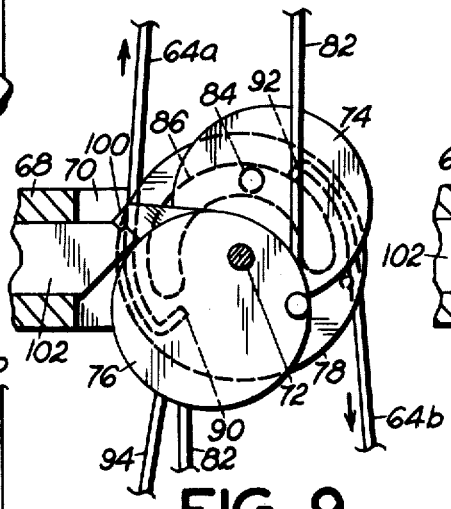
FIG. 9 is a view similar to FIG. 8 but showing a loaded condition of the pre-loading means.

The pulley assembly shown in FIG. 3 can be interchanged with the pulley assembly shown in FIG. 7 and used on the bow shown in FIG. 6. In such case, the flexible link 94 would be used in lieu of flexible link 34 and would be anchored to pulley 24. Flexible link 82 in such arrangement would not be used.

The embodiment shown in FIG. 10 has pre-load energy means which may be loaded by pivotally operated lever means before, during and after final draw.

Multiple locking lugs similar to lug 40 of FIG. 3 may be employed for multiple settings of the pre-load energy.

Pulley 26 of FIG. 4 may be locked by inserting a pin through pulley 26 and bifurcated ends 20 of arm 18. The bow now may be operated as a customary bow, and by locking pulley 26 in different positions of rotation, different draw weights are made available. Also, by reducing the tension of pre-load limb 96 of FIG. 6, the bow may be operated as a customary bow.

Pre-load energy controls, such as shown in FIG. 1, can be operated without a return spring. For example, FIG. 1, with the spring 42 removed, the operator can manipulate the lever 44 to lock and unlock the control. Also, the controls can be made to lock automatically in which case the operator would have to release the lock to shoot the bow.

The bow of FIG. 6 has a first energy source comprising bow arms 62 and a second energy source comprising limb 96. During operation of the bow the projectile is propelled by both energy sources.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. An archery bow comprising (a) a frame having a grip portion for holding the bow, (b) said frame being rigid and forming a body portion of the bow, (c) energy means on said frame for providing a tension in the bow to propel a projectile, (d) a bowstring connected to said energy means and receiving energy to shoot a projectile engaged thereby, (e) and pre-loading means on said bow for loading and holding said energy means in a pre-loaded condition for energy storing in the bow prior to shooting a projectile, said pre-loading means also producing a decrease in a draw force required to draw said bowstring relative to a draw force required prior to operation of said pre-loading means, (f) said pre-loading means being operatively connected to said energy means and said bowstring during pre-loading of said bow, (g) said pre-loading means having a first position which holds said energy means in its pre-loaded condition and a second position which releases said energy means from its pre-loaded condition to be spent during shooting motions of said bow, (h) said pre-loading means being independently operable without coaction with projectiles being shot by the bow and being releasable from its first position to its second position by a draw force of the bowstring, (i) said pre-loading means also including leverage means for increasing the tension in said bow to decrease the draw force required to draw said bowstring.

2. The archery bow of claim 1 wherein said bow includes a rigid support integral with said frame and extending toward the bowstring, a shaft on said support, said pre-loading means including a pulley assembly supported on said shaft, said pulley assembly including a pair of pulley members, said members being operatively engageable with each other and disposed in eccentric relation with each other, said bowstring including a pair of terminal end portions, said pulley assembly being engaged by said terminal end portions, said pre-loading means also including a flexible link connected between said energy means and said pulley assembly so that a rotation of said pulley assembly by said leverage means during pre-loading of said energy means changes the tension available in the bow to propel a projectile.

3. The archery bow of claim 1 wherein said pre-loading means includes a flexible link operatively secured to said energy means, said leverage means tensioning said flexible link during pre-loading of said bow.

4. The archery bow of claim 1 wherein said pre-loading means includes a flexible link operatively secured to said energy means and a pair of pulleys engaged by said flexible link, said pulleys being secured together and engageable by said leverage means for tensioning said flexible link.

5. The archery bow of claim 1 wherein said bow includes a pair of oppositely extending arms on said frame with at least one of said arms being flexible, said pre-loading means including a flexible limb on said bow in addition to said arms operatively connected to said bowstring, said flexible arms and said flexible limb combining to provide tension for said bow to propel a projectile.

6. The archery bow of claim 1 wherein said energy means is adjustably movable on said frame, said pre-loading means including a pump for loading said energy means and means operatively connecting said pump with said bowstring wherein said pump is operated by drawing movement of said bowstring.

7. The archery bow of claim 1 wherein said energy means is adjustably movable on said frame, said pre-loading means including a fluid operated pump for loading said energy means and means operatively connecting said pump with said bowstring whereby said pump is operated by drawing movement of said bowstring or by a lever.

8. The archery bow of claim 1 wherein said bow includes a pair of arms extending from said frame, said energy means including an auxiliary flexible limb positioned adjacent one of said arms, said pre-loading means also including a flexible link connected between said pre-loading means and said flexible limb, said flexible link pre-loading said energy means when drawn in a manner similar to said bowstring.

9. The archery bow of claim 1 wherein said pre-loading means loads said energy means into its pre-loaded condition by a plurality of pulls on the bowstring.

10. The archery bow of claim 1 wherein said pre-loading means includes a flexible link connected to said energy means and positioned adjacent to said bowstring to be drawn in a manner similar to said bowstring for pre-loading said energy means for said bow.

11. The archery bow of claim 1 wherein said bowstring includes an end portion, said pre-loading means including an enlargement selectively positioned on said end portion and said pre-loading means also including an engaging means to engage said enlargement during pre-loading of said bow.

12. An archery bow comprising (a) a frame having a grip portion for holding the bow, (b) said frame being rigid and forming a body portion of the bow, (c) energy means on said frame for providing a tension in the bow to propel a projectile, (d) a bowstring connected to said energy means and receiving energy to shoot a projectile engaged thereby, (e) and pre-loading means on said bow for loading and holding said energy means in a pre-loaded condition for energy storing in the bow prior to shooting a projectile, said pre-loading means also producing a decrease in a draw force required to draw said bowstring relative to a draw force required prior to operation of said pre-loading means, (f) said pre-loading means being operatively connected to said energy means and said bowstring during pre-loading of said bow, (g) said pre-loading means having a first position which holds said energy means in its pre-loaded condition and a second position which releases said energy means from its pre-loaded condition to be spent during shooting motions of said bow, (h) said energy means comprising a pair of oppositely extending arms on said frame with at least one of said arms being flexible for providing the tension in said bow to propel a projectile, (i) said pre-loading means when operated flexes said flexible arm inwardly in a step prior to application of a draw force on the bowstring to decrease the draw force required to draw the bow.

13. An archery bow comprising (a) a frame having a grip portion for holding the bow, (b) said frame being rigid and forming a body portion of the bow, (c) energy means on said frame for providing a tension in the bow to propel a projectile, (d) a bowstring connected to said energy means and receiving energy to shoot a projectile engaged thereby, said bowstring including a pair of terminal end portions, (e) a rigid support integral with said frame and extending rearwardly toward said bowstring, (f) a shaft on said support, (g) a pulley assembly for receiving said bowstring terminal end portions, said assembly being rotatably supported by said shaft and positioned between said frame and said bowstring, (h) said pulley assembly including non-eccentric pulley means supported by said shaft for non-eccentric rotation and rotatable eccentric means eccentrically supported by said shaft for for eccentric rotation, (i) said non-eccentric pulley means and said rotatable eccentric means being engaged with each other, (j) said assembly also including a flexible link means connecting said energy means and said rotatable eccentric means, said non-eccentric pulley means being engaged by the terminal end portions of said bowstring so that a drawing force on said bowstring causes rotation of said non-eccentric pulley means and said rotatable eccentric means.

* * * * *